US009086065B2

(12) United States Patent
Siebertz et al.

(10) Patent No.: US 9,086,065 B2
(45) Date of Patent: Jul. 21, 2015

(54) ADJUSTABLE VANE PUMP FOR REDUCING PRESSURE PULSATIONS DURING DISCHARGE

(71) Applicants: Holger Siebertz, Lohmar (DE); Dirk Sickert, Bruehl (DE); Klaus Becker, Cologne (DE); Thomas Nied-Menninger, Nottuln (DE); Axel Fassbender, Wuppertal (DE)

(72) Inventors: Holger Siebertz, Lohmar (DE); Dirk Sickert, Bruehl (DE); Klaus Becker, Cologne (DE); Thomas Nied-Menninger, Nottuln (DE); Axel Fassbender, Wuppertal (DE)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 263 days.

(21) Appl. No.: 13/656,724

(22) Filed: Oct. 21, 2012

(65) Prior Publication Data

US 2013/0121863 A1 May 16, 2013

(30) Foreign Application Priority Data

Oct. 20, 2011 (EP) ..... 11185888

(51) Int. Cl.

| | |
|---|---|
| ***F04C 2/344*** | (2006.01) |
| ***F04C 14/08*** | (2006.01) |
| ***F04C 14/22*** | (2006.01) |
| ***F04C 15/00*** | (2006.01) |
| ***F01C 21/10*** | (2006.01) |
| ***F04C 2/00*** | (2006.01) |

(52) U.S. Cl.

CPC ..... *F04C 2/00* (2013.01); *F01C 21/108* (2013.01); *F04C 2/3441* (2013.01); *F04C 14/08* (2013.01); *F04C 14/226* (2013.01); *F04C 15/0049* (2013.01); *F04C 2270/13* (2013.01)

(58) Field of Classification Search

CPC .. F01C 21/108; F04C 14/226; F04C 15/0049; F04C 2270/13; F04C 14/24

USPC ..... 418/157, 30, 26

See application file for complete search history.

(56) References Cited

U.S. PATENT DOCUMENTS

| | | | | |
|---|---|---|---|---|
| 6,155,797 | A * | 12/2000 | Kazuyoshi | 418/30 |
| 6,558,132 | B2 * | 5/2003 | Hanggi | 418/30 |
| 7,682,135 | B2 * | 3/2010 | Ueki et al. | 418/30 |
| 2011/0150684 | A1 * | 6/2011 | Tada | 418/26 |

FOREIGN PATENT DOCUMENTS

| | | | |
|---|---|---|---|
| JP | 2007270698 | A * | 10/2007 |
| JP | 2009036137 | A * | 2/2009 |

* cited by examiner

*Primary Examiner* — Mary A Davis

(74) *Attorney, Agent, or Firm* — Joseph E. Root

(57) ABSTRACT

An adjustable rotary vane pump configured to reduce pressure pulsations during hydraulic fluid discharge includes a housing having two side plates positioned in parallel. Each side plate has multiple grooves formed in its surface. A rotor mounted between the side plates has multiple vanes extending radially outward. A lift ring surrounds the rotor, pivotally connected to the housing to swivel between positions eccentric to the housing. During rotation of the rotors, the vanes divide the annular region between the rotor and the lift ring into multiple cells, which alternately position themselves between a suction zone and a pressure zone of the pump. In a transition region between the suction and pressure zone, when the lift ring is between pre-determined angular positions, the grooves within lift ring and the side plate substantially align to create an overflow channel, which transfers the hydraulic fluid from the suction zone to the pressure zone.

3 Claims, 2 Drawing Sheets

ADJUSTABLE VANE PUMP FOR REDUCING PRESSURE PULSATIONS DURING DISCHARGE

TECHNICAL FIELD

The present disclosure generally relates to pumps for transferring hydraulic fluid, and, more specifically, to rotary vane pumps adapted to reduce pressure spikes therein, during discharge of hydraulic fluids from such pumps.

BACKGROUND

Rotary vane pumps are often used in automotive vehicles for transferring hydraulic fluid to power steering, brakes, and transmission, as well as auxiliary systems such as supercharging, etc. Such pumps are variable displacement pumps and include multiple vanes mounted on a rotor that generally rotates inside a cavity. The center of the rotor is positioned eccentrically within the cavity—that is, the rotor is offset from the center of the cavity. The vanes are slidably mounted, so that they can slide radially in and out during rotation. The eccentric position of the rotor means that the walls of the cavity lie at a variable length from the rotor axis. Thus, the pump cells—the volume between adjacent vanes—can vary in volume during a rotation cycle.

When used in the automotive vehicles, the rotors are generally driven directly by the vehicle engine, and the quantity of hydraulic fluid delivered by these pumps varies in response to variations in the engine speed. When the engine speed is relatively high or low, a lift ring is generally provided to ensure an adequate delivery of the hydraulic fluid, and. The lift ring substantially surrounds the rotor, adjustable between different positions eccentric to the rotor. Specifically, the lift ring adjusts the quantity of the hydraulic fluid delivered in direct proportion to the engine speed, thus ensuring adequate delivery.

As the vanes rotate, variations in cell volume create alternating suction and pressure zones. As a cell passes from a suction zone to a pressure zone, a pressure pulse is produced on the delivery side of the pump, and this pulse may lead to undesired noises vibrations within and emanating from the pump.

Attempts have been conventionally made to reduce such vibrations or undesired noises. Some pumps are provided with odd number of vanes, or with control valves within certain openings, to alleviate this problem. Another approach employs V-shaped notches at certain suction and delivery openings. At some angular positions of the moving rotor, these notches form overflow channels between adjacent cells, as the cells transit from the suction zones to the pressure zones. These measures ameliorate the noise problem, but they is may significantly reduce delivery pressure, reducing the pump's effectiveness.

Accordingly, considering the problems noted above, there remains a need for an adjustable vane pump, which may substantially reduce pressure pulsations in the delivered hydraulic fluid, and decrease the noise due to vibrations within mechanical components of the pump, when the rotating vanes transition from the suction zone to the pressure zone within the pump.

SUMMARY

The present disclosure provides a rotary vane pump, which considerably reduces pressure pulsations during discharge of a hydraulic fluid from the pump, and minimizes the noise generated due to vibrations within the mechanical components of the pump, when the moving vanes of the pump transition from the suction zone to the pressure zone.

According to an aspect, the present disclosure provides an adjustable vane pump having a housing that includes two side plates positioned substantially parallel to each other within the housing. Each side plate has multiple grooves provided in it, which receive the flow of a hydraulic fluid. A rotor is mounted between the two side plates, and the rotor has a number of vanes extending radially inside it. A lift ring is pivotally connected to a portion of the pump's housing, and it substantially surrounds the rotor. The lift ring rotates, and swivels between positions eccentric to the rotor. Further, the lift ring also has multiple grooves provided within it. As the rotor rotates, the moving vanes divide the annular region between the lift ring and the rotor into multiple cells, and these cells get positioned alternately between a suction zone and a pressure zone within the pump during rotor's rotation. In the transition region between the suction zone and the pressure zone, within a pre-determined range of angular positions of the swiveling lift ring, the grooves within the lift ring align substantially with the grooves within at least one of the side plates. This alignment creates an intermittent overflow channel that connects the suction zone to the pressure zone. During the process of being delivered, the hydraulic fluid partially flows from the suction zone to the pressure zone, through the overflow channel, and this reduces pressure pulsations during discharge. Further, the position of the swiveling lift ring, during rotation, depends on the rotational speed of the pump's rotor.

Additional aspects, advantages, features and objects of the present disclosure would be made apparent from the drawings and the detailed description of the illustrative embodiments construed in conjunction with the appended claims that follow.

DETAILED DESCRIPTION OF ILLUSTRATIVE EMBODIMENTS

The following detailed description illustrates aspects of the disclosure and the manner in which it can be implemented. However, the description does not define or limit the invention, such definition or limitation being solely contained in the claims appended thereto. Although the best mode of carrying out the invention has been disclosed, those in the art would recognize that other embodiments for carrying out or practicing the invention are also possible.

Figure 1:
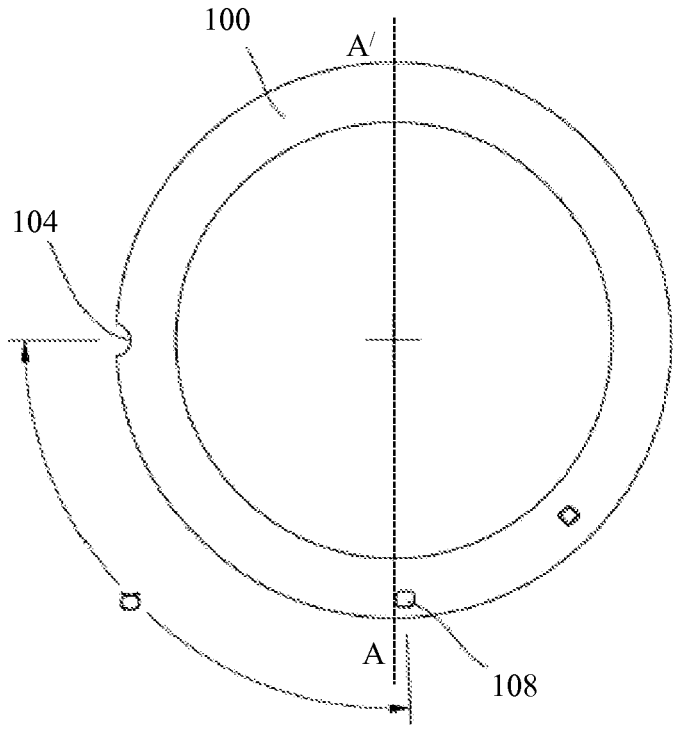
FIG. 1 shows a lift ring of an adjustable rotary vane pump, in accordance with a first embodiment of the present disclosure.

FIG. 1 is a top view of a lift ring 100 of an adjustable rotary vane pump, according to the present disclosure. As noted earlier, a rotor having radial vanes (not shown) is positioned within the lift ring 100, in a manner that the lift ring 100 completely surrounds the rotor. The lift ring 100 is movable between positions that are eccentric to the rotor. As the rotor rotates, its vanes divide the annular region between the lift ring 100 and the rotor into a number of cells, which pass alternately through a suction zone and a pressure zone.

An outer peripheral portion of the lift ring 100 includes an excised, or cut-out, portion 104, extending to a certain depth, and being of a semi-circular shape. The excised portion 104 surrounds a peg 208 (FIG. 2) fixedly attached to a portion of the housing. The lift ring 100 is pivotally connected to the peg 208, with the excised portion 104 engaging and partially surrounding the peg. Any suitable conventional mechanism may be used to pivotally connect the excised portion 104 to the peg 208. Further, the lift ring 100 swivels around the peg, within a range of angular positions about the peg 208, to ensure that it orients itself eccentrically to the rotor.

Though shown as a semi-circular shape, the excised portion 104 may also be of another appropriate shape, depending on the shape and design of the peg, to facilitate ease of fixture and the pivotal connection between the lift ring 100 and the peg 208.

Figure 2:
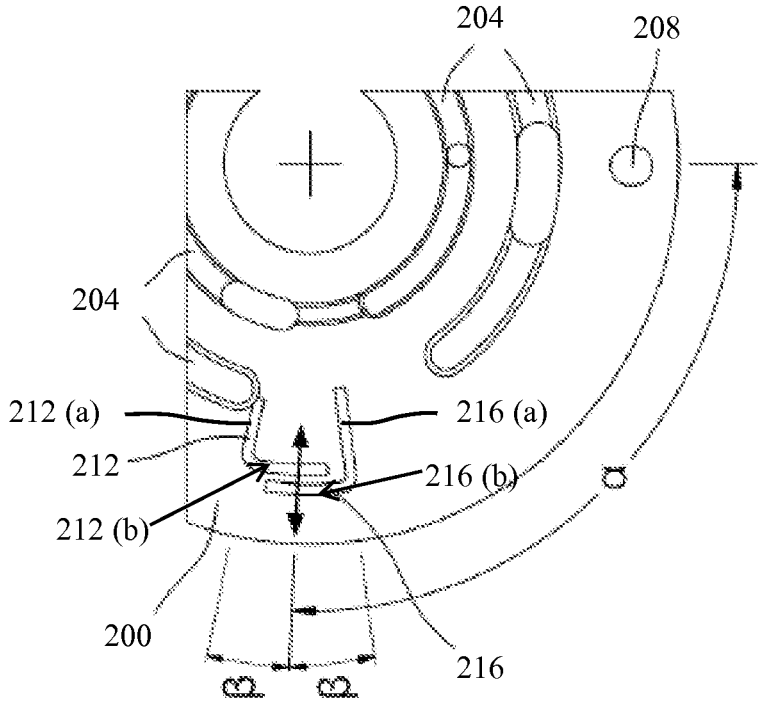
FIG. 2 shows a top view of a segment of a side plate of a rotary vane pump's housing, in accordance with the first embodiment of the present disclosure.

At a specific pre-determined angular distance '$\alpha$' from the excised portion 104, a groove 108 is provided within the lift ring 100. In a preferred embodiment, the groove may be provided at an angle '$\alpha$' of about 92.50. However, other values of the angle '$\alpha$' may also be possible in certain embodiments. The groove 108 has rounded corners, and can define an elliptical, circular, arcuate, or disc-shaped groove. In a typical lift ring 100 having a diameter of about 27 mm., the groove 108 may have a width of about 1.5 mm., a height of about 2 mm., and a depth of about 1 mm., position at a radial distance of about 1-2 mm. inward from the lift ring 100's outer periphery. The noted positioning, radial distance, and dimensions of the groove 108 are merely exemplary, and may vary in certain FIG. 2 is a top view of a side plate 200 of the pump's housing, according to the present disclosure. As shown, the side plate 200 has a number of arcuate channels 204. The channels 204 are delivery channels for the hydraulic fluids, as seen in conventional vane pumps. A peg 208 is provided through an outer peripheral surface of the side plate 200. The lift ring 100 for the pump (shown in FIG. 1) swivels around the peg 208, during its rotation between eccentric positions, when it aligns with, and connects to the side plate 200. Specifically, the peg extends through the peg 208, and engages the excised portion 104 of the lift ring 100. Thus, the peg 208 facilitates pivotal connection of the lift ring 100 to the peg. The alignment of the lift ring 100 with the side plate 200 can be visualized as being brought by placing the lift ring 100 concentrically with the side plate 200. In that orientation, the excised portion 104 (shown in FIG. 1) of the lift ring 100 substantially aligns with the peg 208 in the side plate 200. During operation, the lift ring 100 rocks back and forth around the peg. The pivotal connection of the lift ring 100 to the peg of the pump's housing is made in that orientation of the lift ring 100.

With respect to the outer peripheral surface of the side plate 200, and with reference to the peg 208, an angular range of $\alpha\pm\beta$ is shown in FIG. 2. This angular range encloses a transition region between the suction zone and the pressure zone of the rotary vane pump. Further, within the angular range $\alpha\pm\beta$, the side plate has two grooves 212, 216 formed in its surface. Each groove 212, 216 is generally L-shaped, with one L being flipped backward. The first groove 212 has a first portion 212 (*a*), which extends radially inwards, towards the center of the side plate 200, and lies substantially outside the transition region between the suction zone and the pressure zone of the pump. A second portion 212 (*b*) of the first groove 212 extends substantially circumferentially and lies within the transition zone. Similarly, the second groove 216 has a first portion 216 (*a*) that extends radially inwards, towards the center of the side plate 200, away from the transition region, and a second portion 216 (*b*), which extends circumferentially and lies within the transition region. Further, the first portion and the second portion of each of the two grooves 212 and 216 are connected by a curved section, to maintain continuity in the entire groove, for the hydraulic fluid's flow therein, from the suction zone to the pressure zone, and vice versa.

The first portions 212 (*a*) and 216 (*b*) of the first groove 212 and the second groove 216, respectively, extend to a point at a lesser radial distance from the center of the side plate 200, than the distance of the inner peripheral surface of lift ring 100 from the center of the side plate 200, when the lift ring 100 engages and aligns with the side plate 200. Specifically, when the lift ring 100 and the side plate 200 align, the radially inward ends of the first portions of each of the grooves 212 and 216 lie within the inner peripheral region of the lift ring 100.

In an embodiment where the side plate 200 has a diameter of about 30 mm., the grooves 212 and 216, each have a width and depth of about 1 mm. However, these dimensions may vary, and the actual length, width and depth of the grooves 212 and 216 depends on the size of the side plate 200, and the peripheral dimensions of the lift ring 100.

The communication of the grooves 212 and 216 of the side plate 200, with the groove 108 within the lift ring, forms an overflow channel. As noted earlier, the lift ring 100 is positioned by aligning it concentrically with the side plate 200, so that excised portion 104 engages the peg. At that point, the lift ring 100 is configured to swivel about the peg 208, and the groove 108 (on lift ring 100) substantially aligns with the circumferential portions 212 (*b*) and 216 (*b*) of the side plate 200. As the lift ring 100 swivels about the peg, and its rotational speed increases, the groove 108 moves along the bidirectional arrow, as shown in FIG. 2, over the transverse portions 212 (*b*) and 216 (*b*) of the grooves 212 and 216. When this happens, an intermittent overflow channel is created between the suction zone and the pressure zone. The formed overflow channel brings the suction zone and the pressure zone in fluid communication and transfers a quantity of hydraulic fluid from the suction zone to the pressure zone. The effect of that transfer is to reduce pressure pulsations at the delivery side of the pump.

Further, it is evident from FIG. 1 and FIG. 2, that the overflow channel is conditionally created when the grooves 212 and 216 within the side plate 200 align with the groove 108 of the lift ring 100, only when the lift ring 100 is within certain positional orientations. More specifically, the overflow channel is created only when the lift ring is concentric with the side plate 200 and its major portion substantially overlaps the side plate 200, as it swivels around the peg 208. Further, since the position of the swiveling lift ring 100 depends on the rotational speed of the pump's rotor, the intermittent overflow channel connecting the suction zone to the pressure zone is formed only within a specific rotational speed range of the rotor. Through an appropriate optimization of the design and dimensions of the grooves 212 and 216 within the side plate 200, and the groove 108 within the lift ring 100, the rotational speed range for the rotor, within which the overflow channel is created, can be varied, to substantially reduce pressure pulsations within the pump, and to minimize the noise produced in the pump due to vibrations. Therefore, the illustrated shapes and dimensions for the grooves within the lift ring 100 and the side plate 200 are only exemplary.

In one embodiment, a second side plate of the pump housing (not shown), having shape similar to the side plate 200, is positioned opposite to the side plate 200. This plate and may also have grooves similar in shape to the grooves 212 and 216. In that embodiment, the lift ring 100 may be positioned between the two side plates, and the grooves of the type 212 and 216, within the second side plate, may cooperate with grooves of the type 108 provided on another side wall of the lift ring 100, in the aforementioned manner, to form another overflow channel.

In the embodiment illustrated in conjunction with FIG. 1 and FIG. 2, the two openings of the overflow channel, leading into the suction zone and the pressure zone, respectively, run inside the side plate 200. However, in some embodiments, the two openings may also run within the lift ring 100, as will be illustrated hereinafter in conjunction with the figures to follow.

Figure 3:
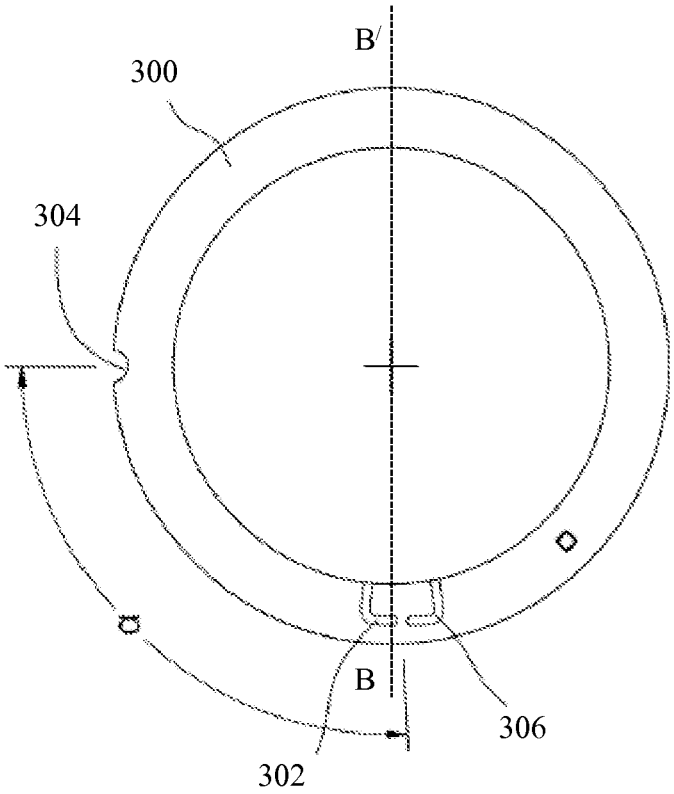
FIG. 3 shows a lift ring of an adjustable rotary vane pump, in accordance with a second embodiment of the present disclosure.

FIG. 3 shows a top view of a lift ring 300 of the rotary vane pump, in accordance with a second embodiment of the disclosure. The lift ring 300 has an excised portion 304, having a semi-circular shape, which aligns with a peg 408 extending from a side plate of the pump housing. Further, in the illustrated embodiment, the outer peripheral portion of the lift ring 300 has two grooves 302 and 306. Each of the grooves 302 and 306 has a first portion that extends radially inwards, into the lift ring 300, away from the transition zone, and a second portion extending circumferentially, with respect to the lift ring 300, and lying within the transition zone. The circumferentially extending second portions of the two grooves 302 and 306 are spaced apart from each other, about the center of the lift ring 300, by a gap between these two portions. These portions remain in the transition region between the suction zone and the pressure zone when the lift ring 300 aligns with a side plate of the pump housing.

Figure 4:
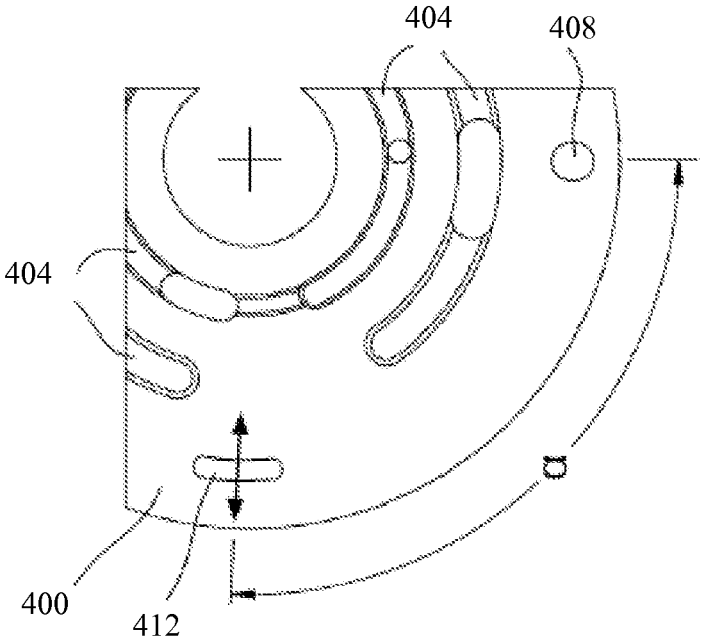
FIG. 4 shows a top view of a segment of a side plate of a rotary vane pump's housing, in accordance with the second embodiment of the present disclosure.

FIG. 4 is a top view of a side plate 400 of the pump, configured to align with the lift ring 300 of FIG. 3, in accordance with the second embodiment of the present disclosure. The side plate 400 has a peg 408 through which the peg fixed to the pump's housing is configured to pass. The peg 408 facilitates pivotal connection of the lift ring 300 to the peg. Specifically, the excised portion 304 of the lift ring 300 (shown in FIG. 3), aligns with the peg 408 and the excised portion 304. A suitable mechanism may pivotally connect the lift ring 300 to the peg, allowing lift ring 300 to rotate about the peg 408, within a pre-determined range of angular positions.

The alignment and cooperation of the lift ring 300 and the side plate 400, creating overflow channels, is now described in conjunction with FIG. 3 and FIG. 4. The lift ring 300, is rotated by 1800 clockwise, about the axis BB/and positioned concentrically with the side plate 400. That orientation of the lift ring 300 brings the excised portion in alignment with the hole peg 408 within the side plate 400. Further, this movement brings the grooves 302 and 306 of the lift ring 300 in overlying position with respect to the groove 412 of the side plate 400. The lift ring 300, pivotally connected to the peg 408, swivels around the peg 408, within a range of angular positions, as the rotor of the pump rotates.

When the lift ring 300 swivels, the groove 412 within the side plate 400 moves along the bidirectional arrow, as shown in FIG. 4, over the circumferentially extending second portions of the grooves 302 and 306 within the lift ring 300. In this manner, the groove 412 cooperates with the grooves 302 and 306, and an intermittent overflow channels (not shown) is formed. The overflow channel transmits a quantity of hydraulic fluid from the suction zone to the pressure zone of the pump, and reduces pressure pulsations during discharge of the hydraulic fluid through the pump.

Further, as noted earlier, the overflow channel is formed only within a specific rotational speed range of the rotor of the pump, when the groove 412 within the side plate substantially overlays the circumferentially positioned second portions of the two grooves 302 and 306 within the lift ring 300.

One of the two openings of the formed overflow channel, lying in either the suction zone or the pressure zone of the pump, may run within the side plate, and the other opening, may run within the lift ring. Further, both openings may also run within either the side plate or the lift ring.

The forms, arrangement, and the shape of the grooves provided within the side plate of the pump housing, and the lift ring, which cooperate to form the intermitted overflow channels, are merely exemplary, and can be modified in various ways. Further, more than the specific illustrated number of grooves can be provided within the side plate or the lift ring, in certain embodiments, to form multiple intermitted overflow channels during alignment of the lift ring and the side plates, based on the requirement.

Embodiments of the present disclosure also cover the cases where pressure pulsation and noise within the pump may occur at several different rotational speed ranges of the rotor. Those embodiments address the problem by providing multiple grooves within the side plates of the pump housing, and the lift ring, and those grooves cooperate and align to create multiple intermitted overflow channels covering all such rotational speed ranges. Further, as noted earlier, both the side plates of the pump housing may have grooves, which may cooperate one each with grooves within both the sides of the lift ring, to create overflow channels.

Although the current invention has been described comprehensively, in considerable detail to cover the possible aspects and embodiments, those skilled in the art would recognize that other versions of the invention are also possible.

What is claimed is:

1. In a rotary vane pump, having a rotor carrying a plurality of vanes, having a pressure zone, a transition zone, and a suction zone, with at least one side plate mounted perpendicularly to the rotor, the improvement comprising:

a side plate, including:

a peg extending from the side plate opposite from the rotor; and first and second side plate grooves formed through the side plate, both of the first and second side plate grooves having first portions extending radially inwards toward the center of the side plate, and second portions, extending substantially circumferentially, the two second portions positioned to overlap radially, generally centered over the transition zone, the first portions being on opposite sides of the pair of first and second grooves;

a lift ring including:

an excised portion in the periphery thereof, the excised portion dimensioned to pivotally engage the peg, the degree of pivotal rotation of the lift ring being governed by the rotational speed of the rotor;

at least one lift-ring groove formed in the surface of the lift ring;

wherein the first and second side plate grooves and the at least one lift ring groove are positioned and dimensioned such that the at least one lift ring groove is sufficiently large to overlie both of the first and second side plate grooves, forming a path of fluid flow through the first side plate groove, the at least one lift ring groove, and the second side plate groove;

the pivotal rotation of the lift ring causes the at least one lift ring groove to describe an arc, overlying the side plate at respective positions intermittently aligning with the first and second side plate grooves; and the intermittent alignment of the at least one lift ring groove and the first and second side plate grooves occurs at selected rotor speeds.

2. The rotary vane pump of claim 1, wherein the fluid flow extends from the pressure zone to the suction zone.

3. In a rotary vane pump, having a rotor carrying a plurality of vanes, having a pressure zone, a transition zone, and a suction zone, with at least one side plate mounted perpendicularly to the rotor, the improvement comprising:

a side plate, including:

a peg extending from the side plate opposite from the rotor; and a side plate groove formed through the side plate;

a lift ring including:

an excised portion in the periphery thereof, the excised portion dimensioned to pivotally engage the peg, the degree of pivotal rotation of the lift ring being governed by the rotational speed of the rotor;

first and second lift ring grooves formed in the surface of the lift ring, both of the first and second lift ring grooves having first portions extending radially outwards from the periphery of the lift ring, and second portions, extending substantially circumferentially toward one another from respective ends of the first portions, the ends of the two second portions being separated by a gap generally centered over the transition zone;

wherein the side plate groove and the first and second lift ring grooves are positioned and dimensioned such that the side plate groove is sufficiently large to overlie the ends of both of the first and second lift ring grooves second portions, forming a path of fluid flow through the first lift ring groove, the side plate groove, and the second lift ring groove;

the pivotal rotation of the lift ring causes the first and second lift ring grooves to describe an arc, overlying the side plate at respective positions intermittently aligning with the side plate groove; and the intermittent alignment of the first and second lift ring grooves and side plate groove occurs at selected rotor speeds.

* * * * *